United States Patent [19]

Saito et al.

[11] Patent Number: 4,491,657

[45] Date of Patent: Jan. 1, 1985

[54] POLYESTER MULTIFILAMENT YARN AND PROCESS FOR PRODUCING THEREOF

[75] Inventors: Isoo Saito, Okazaki; Kotaro Fujioka, Nagoya; Hajime Arai; Hideo Saruyama, both of Okazaki, all of Japan

[73] Assignee: Toray Industries, Inc., Tokyo, Japan

[21] Appl. No.: 354,200

[22] Filed: Mar. 3, 1982

[30] Foreign Application Priority Data

Mar. 13, 1981 [JP] Japan ..... 56-35290

[51] Int. Cl.[3] ..... C08G 63/02

[52] U.S. Cl. ..... 528/308.1; 264/176 F; 264/210.8; 528/308.2; 528/308.6

[58] Field of Search ..... 264/176 F, 210.8; 528/308.1, 308.2, 308.6

[56] References Cited

U.S. PATENT DOCUMENTS

| | | | |
|---|---|---|---|
| 3,969,462 | 7/1976 | Stofan | 264/210.8 |
| 4,101,525 | 7/1978 | Davis et al. | 264/176 F |
| 4,134,882 | 1/1979 | Frankfort et al. | 528/308.2 |
| 4,156,071 | 5/1979 | Knox | 528/308.2 |
| 4,338,275 | 7/1982 | Carr | 264/237 |
| 4,349,501 | 9/1982 | Hamlyn | 264/210.8 |
| 4,374,797 | 2/1983 | Koschinek et al. | 264/210.8 |

*Primary Examiner*—Donald Czaja
*Assistant Examiner*—Mary A. Becker
*Attorney, Agent, or Firm*—Austin R. Miller

[57] ABSTRACT

A polyester multifilament yarn which has the following properties: an initial modulus (Mi) of 90 to 130 grams per denier, a terminal modulus (Mt), a shrinkage index value (ΔS/IV) of 2 to 8 percent, a birefringence (Δn) of $165\times10^{-3}$ to $190\times10^{3}$, a crystalline orientation function (fc) of 0.93 to 0.97, a crystal size (D) 47 to 55 angstroms, a long period (Lp) of 130 to 145 angstroms, a molecular orientation index in the amorphous region ($\bar{F}$) of 0.80 to 0.92, and a concentration of carboxyl end groups (—COOH) of 0 to 25 equivalents per $10^6$ grams of the polymer is disclosed. The yarn is improved in modulus and shrinkage. A textile reinforcement for tire cord obtained from the multifilament yarn, exhibits exceedingly improved resistance to fatigue and durability to heating. The polyester multifilament yarn is obtained by (A) melt-spinning polymer at high speed (B) solidifying the spun yarn through a solidification zone comprising (a) a heating zone and (b) cooling zone adjacent to the lower part of the heating zone, and (C) withdrawing the solidified yarn, and (D) hot drawing the yarn.

8 Claims, 5 Drawing Figures

POLYESTER MULTIFILAMENT YARN AND PROCESS FOR PRODUCING THEREOF

BACKGROUND OF THE INVENTION

1. Field of the Invention

This invention relates to a polyester multifilament yarn, particularly to a polyester multifilament yarn which (a) has high modulus and low shrinkage and (b) is useful in the textile reinforcement of tires, providing greatly improved resistance to fatigue and durability on heating, and to a process for producing the polyester multifilament yarn.

2. Description of the Prior Art .

Recently it has been demanded that automobiles be superior in comfort, stable in handling during driving at high speed, and light in weight.

Therefore it has been desired to create a yarn having high modulus, low shrinkage, and improved resistance to fatigue and durability on heating as textile reinforcement of the rubber matrix of tires.

A process for producing an improved polyethylene terephthalate multifilament yarn having the above characteristics is disclosed in U.S. Pat. No. 4,101,525. The method disclosed in the above U.S. patent comprises;

(a) extruding a melted polyethylene terephthalate from a spinneret to form a multifilament yarn, (b) passing the yarn through the solidification zone without heating to cool the yarn immediately, (c) withdrawing the yarn from the solidification zone under a stress of 0.015 to 0.150 gram per denier, and (d) drawing the yarn.

This method is superior in obtaining polyethylene terephthalate multifilament yarn which can be used to produce tires having little heat generation during tire rotation when driving.

However, this method has been desired to be improved due to the following problems;

(1) The multifilament yarn can not be stably obtained. The spun yarn tends to break in spinning or in withdrawing, since the yarn is immediately cooled in the solidification zone after spinning. In particular, when a large denier filament yarn is spun, denier unevenness inevitably occurs.

(2) The tenacity of the tire cord which is obtained by twisting the yarn, by spreading an adhesive on the surface of the yarn, and then heat-treating in a stretched condition, decreases in an unusual degree, as compared with the tenacity of the untreated multifilament yarn.

(3) When the tire cord is incorporated in the rubber matrix of tires, decomposition of hydrolysis of the cord is easily caused during the tire rotation when driving.

OBJECT OF THE INVENTION

It is an object of the present invention to provide a polyester multifilament yarn having improved properties of high modulus, low shrinkage, and having excellent resistance to fatigue and durability on heating and to provide a process for producing same.

It is a further object of the present invention to provide an improved polyester multifilament yarn that can be formed into tire cord without decreasing the physical properties of the tire cord significantly, as compared with those of a multifilament yarn which is formed into tire cord by twisting the yarn, spreading on adhesive on the surface of the cord, and heat-treating in a stretched condition, and to provide a process for producing same.

It is a still further object of the present invention to provide a method of melt-spinning at high speed spinning conditions with few yarn breaks.

SUMMARY OF THE INVENTION

It has been found that in a polyester multifilament yarn obtained from a polymer comprising at least 90 mol percent ethylene terephthalate as a repeating unit in the molecular chain, the polyester multifilament yarn has the following combination of characteristics;

(A) an initial modulus (Mi) of 90 to 130 grams per denier, (B) a terminal modulus (Mt) of 0 to 15 grams per denier, (C) a shrinkage index value of 2 to 8 percent expressed by the ratio of the shrinkage ($\Delta S$) at dry heating to the intrinsic viscosity (IV)

(D) a birefringence value ($\Delta n$) of $165\times10^{-3}$ to $190\times10^{-3}$, (E) a crystalline orientation function ($f_c$) of 0.93 to 0.97, (F) a crystal size of (D) of 47 to 55 angstroms, (G) a long period (Lp) of 130 to 145 angstroms, (H) a molecular orientation index in the amorphous region ($\bar{F}$) of 0.80 to 0.92, and (I) a concentration of carboxyl end groups (—COOH) of 0 to 25 equivalents per $10^6$ grams of the polymer.

Additionally, it has been found that a polyester multifilament yarn of the present invention may be obtained by a process comprising the following steps (A) to (D);

(A) melt-spinning polyester, comprising at least 90 mol percent ethylene terephthalate as a repeating unit in the molecular chain, wherein the polymer melted and extruded from the spinneret has an intrinsic viscosity (IV) of 0.80 to 1.20 deciliters per gram and a concentration of carboxyl end groups (—COOH) of 0 to 25 equivalents per $10^6$ grams of the polymer.

(B) solidifying the spun multifilament yarn gradually by passing the yarn through a solidification zone which comprises (a) a heating zone comprising a gaseous atmosphere surrounded with a barrel-shaped heater having a length of 0.2 to 1 meter and heated at a temperature of the melting point of the polymer to 400° C., and (b) a cooling zone subsequent to the heating zone and adjacent to the lower part of the heating zone and having an atmosphere of externally introduced air, at a temperature of 10° to 40° C., (C) withdrawing the solidified multifilament yarn from the cooling zone at a speed (V) of 2 to 6 kilometers per minute to form a partially-oriented multifilament yarn having a birefringence ($\Delta n$) of $$0.7\times10^{-3}\times(7.2V^2-20V+30) \text{ to}$$

$$1.3\times10^{-3}\times(7.2V^2-20V+30),$$

and (D) hot drawing the partially-oriented multifilament yarn at a draw ratio of 1.4 to 3.5 before or after winding it as a package on a bobbin.

DESCRIPTION OF THE PREFERRED EMBODIMENTS

Figure 1:
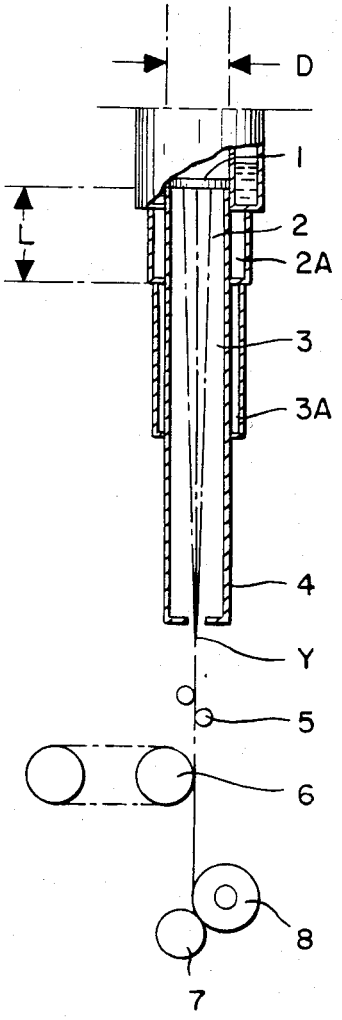
FIGS. 1, 2, 3, and 4 illustrate a representative apparatus arrangement for carrying out the process of the present invention whereby the polyester multifilament yarn of the present invention is formed.

The polyester multifilament yarn of the present invention is obtained from a polymer comprising at least 90 mol percent ethylene terephthalate as a repeating unit in the molecular chain. The polymer may incorporate as copolymer units at most 10 mol percent of one or more ester-forming ingredients other than ethylene glycol and terephthalic acid or its derivatives. Illustrative examples of other ester-forming ingredients which may be copolymerized with the ethylene terephthalate unit include glycols such as diethylene glycol, trimethylene glycol, tetramethylene glycol, hexamethylene glycol, hexahydro-p-xylene glycol, etc., and dicarboxylic acids such as isophthalic acid, hexahydroterephthalic acid, bibenzoic acid, p-terphenyl-4,4'-dicarboxylic acid, adipic acid, sebacic acid, azelaic acid, etc.

The polymer has an intrinsic viscosity (IV) of 0.80 to 1.20, preferably 0.9 to 1.20 deciliters per gram, and has a concentration of carboxyl end groups (—COOH) of 0 to 25, preferably 0 to 15 equivalents per $10^6$ grams of the polymer, when the polymer is melted and extruded from the spinneret. Therefore, as the polymer which is provided to be melt-spun, a polymer having an intrinsic viscosity (IV) of 0.80 to 1.40 deciliters per gram, and having a concentration of carboxyl end groups (—COOH) of at most 20 equivalents per $10^6$ grams of the polymer, is used. As one method of controlling the concentration of carboxyl end groups (—COOH), the method wherein an end group blocking agent that is reactive with the carboxyl end group is added to the polymer before melting or at the time of melting, may be employed. In order to obtain a polymer which has a low concentration of carboxyl end groups (—COOH), the method when ester-forming constituents are polymerized at a low temperature, the method wherein an end group blocking agent is added to the polymerization reaction system, or the combination thereof, may be applied.

The amount of polymer produced in melt-polymerization depends on the polymerization reaction rate. Therefore, in known methods, in order to carry out the polymerization reaction as rapidly as possible, the temperature at which the polymer is heated in polymerization reaction system, is set as high as possible while not causing significant deterioration of the polymer. The range of temperatures set in the polymerization is generally 285°–300° C. In this case, the obtained polymer has a concentration of carboxyl end groups (—COOH) of 30–45 equivalents per $10^6$ grams of the polymer when the polymer has an intrinsic viscosity (IV) of 0.6–0.7 deciliter per gram.

The polymerization temperature in the present invention, however, is maintained at 265°–280° C., preferably 270°–280° C., which is lower than in the known method, in order to obtain a polymer having an intrinsic viscosity (IV) of 0.6–0.7 deciliter per gram. In this case the obtained polymer has a concentration of carboxyl end groups (—COOH) of 15–30 equivalents per $10^6$ grams of the polymer.

A polymer having a relatively low intrinsic viscosity (IV), is provided to a solid-phase polymerization system, to form the polymer having an intrinsic viscosity of 0.80–1.40 deciliters per gram. When the solid-phase polymerization is carried out at a temperature of 230°–235° C., the intrinsic viscosity (IV) of the polymer increases to 1.40 from 0.80 deciliters per gram and the carboxyl end groups (—COOH) decrease to 10–20 from 15–30 equivalents per $10^6$ grams of the polymer. In this way, a polymer having a concentration of carboxyl end groups (—COOH) of at most 20 equivalents per $10^6$ grams of the polymer is obtained. The polymer can be used in the melt-spinning of the yarn of the present invention.

In the method wherein an end group blocking agent is added to the polymer, as a carboxyl end group blocking agent, the following compounds may be used; epoxides such as phenylglycidyl ether, o-phenyl phenylglycidyl ether, benzylglycidyl ether, ethylene oxide, carbodiimides such as N,N'-di-o-toluyl carbodiimide, N,N'-di-2,6-dimethylphenyl carbodiimide, isocyanates such as tolylene diisocyanate, 4,4'-methylene bis(-phenylisocyanate), and polyurethanes. Preferably, the addition reaction type compound which has only one functional group and produces no by-product, such as monoepoxy compounds and monocarbodiimide compounds, may be used. The end group blocking agent may be preferably added in an amount of at most 3 weight percent on the basis of the weight of the polymer. When the end group blocking agent is added at over 3 weight percent, decrease of the intrinsic viscosity (IV), or problems in spinning, and in drawing, are caused. The end group blocking agent may be added to the polymer chip before or after or during drying of the polymer chip. The method of providing it to the entrance of the spinning machine in a constant rate, and the method of providing it to a flow of the melted polymer in a constant rate under elevated pressure may be adopted. Preferably the former method is employed. By doing so, better industrial handling and more uniform characteristics of the multifilament yarn are obtained.

The melt-spun multifilament yarn Y is solidified through the solidification zone and followed by withdrawal from the zone on withdrawing roller 6. The yarn may be withdrawn at a speed of more than 2 kilometers per minute, preferably more than 3 kilometers per minute on withdrawing roller 6. When the yarn is withdrawn at a speed of less than 2 kilometers per minute, the important characteristics of the multifilament yarn required for tire cords, an initial modulus (Mi) of more than 90 grams per denier and a terminal modulus (Mt) of less than 15 grams per denier, are not obtained.

In the present invention, it is important not only to control the above-mentioned speed of winding, but also to control the temperature of the atmosphere around the spun yarn in heating zone 2 which contacts with spinneret 1 below, and to control the temperature and the amount of air blown into cooling zone 3 adjacent to the lower part of heating zone 2. The atmosphere around the spun yarn includes the zone surrounded with barrel-shaped heater 2A provided under spinneret 1. Heating zone 2 has a temperature between the melting point of the polymer and 400° C., preferably between the temperature of spinning and 360° C. The above-mentioned temperature must be maintained at least throughout the region from spinneret 1 to more than 10 centimeters below spinneret 1. The temperature of barrel-shaped heater 2A may be set according to the variation of the intrinsic viscosity (IV) of the polymer, the amount of the extruded polymer per a hole of spinneret 1, and the speed of the spinning. In order to spin the multifilament yarn stably without causing variation of the air flow in barrel-shaped heater 2A, it is advantageous to use a heating method such that the temperature in heating zone 2 gradually decreases with distance from spinneret 1. The barrel-shaped heater may possess a length (L) of 0.2 to 1 meter, preferably 0.3 to 0.7 meter, and an internal radius (D) of 0.1 to 0.8 meter. The ratio of the length (L) to the internal radius may be more than 1.

Cooling chimney 3A, where spun yarn Y is cooled immediately after passing through barrel-shaped heater 2A, is disposed below barrel-shaped heater 2A, with or without relaying an adiabatic zone having a length of 0.01 to 0.15 meter. As the cooling chimney, for example, a circular type apparatus where the air is positively blown into the cooling zone from all around the wall of the chimney, a uni-flow type apparatus where the air is positively blown into the cooling zone from one side of the wall in the chimney, and a suction type apparatus where the air is not blown into the cooling zone, but an air flow is naturally generated by the running yarn may be adopted. Preferably the circular type air blowing apparatus may be applied. In the present invention it is important that constant atmospheric conditions be maintained, for example variation of the air flow or variation of the temperature in the cooling chimney should not occur. The yarn which is solidified after passing through cooling zone 3 passes through duct 4. Thereafter the yarn is lubricated by oiling apparatus 5 and is then withdrawn on a pair of withdrawing rollers 6, for example a pair of skewed rollers or a pair of Nelson rollers with adjustment of withdrawing to a prescribed speed. As the oiling apparatus 5, an oiling roller is preferably used. In order to improve the adhesion of the yarn to the rubber matrix or the other materials, agents such as epoxides and isocyanates having multifunctional groups may be applied to the yarn with the lubricant or independently.

In the present invention the spun yarn is withdrawn on withdrawing roller 6 at a speed (V) to form a partially-oriented multifilament yarn having a birefringence ($\Delta n$) of $$0.7\times10^{-3}\times(7.2V^2-20V+30) \text{ to}$$

$$1.3\times10^{-3}\times(7.2V^2-20V+30), \text{ preferably}$$

$$0.8\times10^{-3}\times(7.2V^2-20V+30) \text{ to}$$

$$1.2\times10^{-3}\times(7.2V^2-20V+30).$$

in order to form a partially-oriented multifilament yarn having the above-mentioned birefringence ($\Delta n$), it is necessary to decide the intrinsic viscosity (IV) in connection with the temperature and the length of barrel-shaped-heater 2A and cooling chimney 3A which control the atmosphere therein. The withdrawn yarn after passing a pair of withdrawing rollers 6 is wound around a bobbin which is rotated by winder 7 to form a package of undrawn yarn 8.

Figure 3:
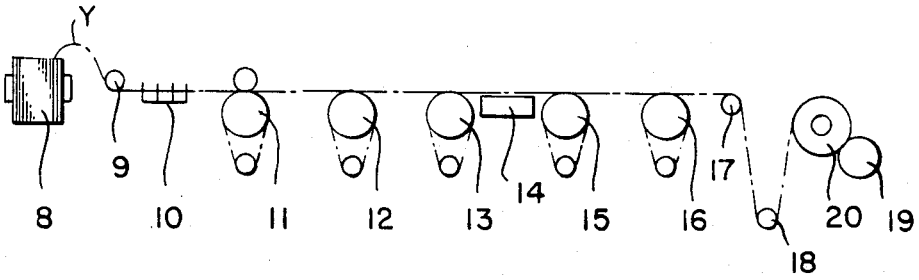
Figure 4:
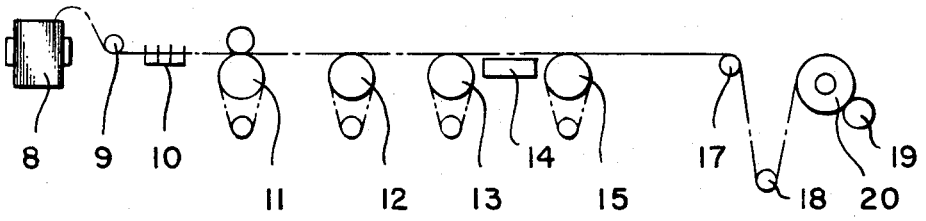

The partially-oriented multifilament yarn, after withdrawing, is drawn before or after winding on the bobbin to form a package. As the drawing method, a multi-step drawing method which is adopted in order to obtain high tenacity polyester multifilament yarn in general, is preferably used. However, a one-step drawing method may be also adopted, since the partially-oriented multifilament yarn already has relatively high molecular orientation. The total draw ratio is 1.4 to 3.5 times, commonly 1.5 to 3.0 times the length of partially-oriented multifilament yarn. An example of the appropriate drawing method is shown as follows; FIG. 3 illustrates a representative apparatus arrangement for carrying out a process of the two-step drawing method which is adopted on drawing at a draw ratio of more than 1.8 times. The undrawn yarn 8 passes guide 9 and tension controller 10, and reaches a first feed roller (1FR) 11. First feed roller (1FR) 11 has a temperature of less than the glass transition temperature (Tg) of polyester, commonly room temperature. Second feed roller (2FR) 12, first draw roller (1DR) 13, heating plate (HPL) 14, and second draw roller (2DR) 15, respectively, have temperatures of the glass transition temperature (Tg) to 120° C., 100° to 160° C., 160° to 230° C., and 160° to 250° C. The temperature of the element selected from these rollers (2FR, 1DR, and 2DR) and heating plate (HPL), is set at the same or higher temperature than that of the elements neighbouring upper in the current of the yarn running. In the present invention the heating plate need not always be used. Tension controlling roller (RR) 16 has a temperature of less than 250° C. The draw ratio for drawing the partially-oriented multifilament yarn between first feed roller (1FR) 11 and second feed roller (2FR) 12 is 1.00 to 1.05 times so that no substantial drawing occurs. Instead of first feed roller (1FR) 11, another apparatus, for example, a tenser may be used. The multifilament yarn is drawn at a draw ratio of 1.2 to 1.8 times between second feed roller (2FR) 12 and first draw roller (1DR) 13. Thereafter, it is continuously drawn at a draw ratio of 1.2 to 2.0 times between first draw roller (1DR) and second draw roller (2DR) 15. The draw ratio between second draw roller (2DR) 15 and tension controlling roller (RR) 16 is 0.95 to 1.02 times, and in that draw ratio the yarn is shrunk or stretched slightly. The drawn yarn, after passing tension controlling roller (RR) 16, is wound as a package of drawn yarn 20 around a bobbin which is rotated by a winder 19, by guide roller 17 and tension controller 18. FIG. 4 illustrates a representative apparatus arrangement for carrying out a process of the one-step drawing method which is adopted for drawing the partially-oriented multifilament yarn at a draw ratio of less than 2.4 times. This method is adopted in order to simplify the process for drawing the yarn. In order to obtain better properties in the multifilament yarn, the two-step drawing method is preferably employed. Each roller and the heating plate have the same temperature as those of the corresponding rollers and the heating plate in FIG. 3. The draw ratio between first feed roller (1FR) and second feed roller (2FR) 12 is 1.00 to 1.03 times. The multifilament yarn is drawn at a draw ratio of less than 2.4 times between second feed roller (2FR) 12 and draw roller (DR) 15. The draw ratio between draw roller (DR) 15 and tension controlling roller (RR) 16 is 0.95 to 1.05 times.

Figure 2:
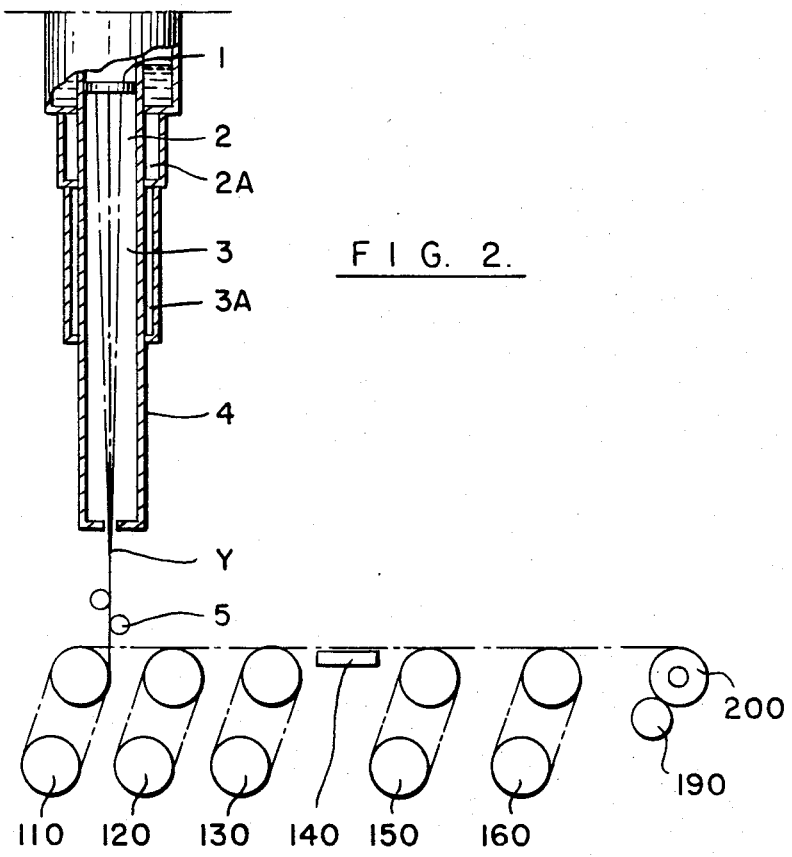

According to the present invention the withdrawn yarn may be drawn without winding it around a bobbin as a package (direct spin-drawing process). FIG. 2 illustrates a representative apparatus arrangement for carrying out the direct spin-drawing process. In the present invention, the direct spin-drawing process is comprised of spinning followed by the two-step drawing that is the same as the two-step drawing method in FIG. 3, the two-step drawing being adopted on drawing at a draw ratio of more than 1.8 times. First feed roller (1FR) 110, second feed roller (2FR) 120, first draw roller (1DR) 130, and the second draw roller (2DR) 150, respectively, have temperatures of 60° to 120° C., 70° to 160°

C., 100° to 180° C., and 180° to 260° C. The temperature of the element selected from these rollers (1FR, 2FR, 1DR, and 2DR) is set at the same or higher temperature than that of the elements neighbouring upper in the current of the yarn running. Heating plate (HPL) 14 and first feed roller (1FR) 110 may not always be used. Tension controlling roller (RR) 160 may have a temperature of less than 260° C., commonly room temperature. The multifilament yarn is drawn at a draw ratio of 1.00 to 1.10 times between first feed roller (1FR) 110 and second feed roller (2FR) 120, at a draw ratio of 1.2 to 1.8 times between second feed roller (2FR) 120 and first draw roller (1DR) 130, and at a draw ratio of 1.2 to 2.0 times between first draw roller (1DR) 130 and second draw roller (2DR) 150. The draw ratio between second draw roller (2DR) 150 and tension controlling roller (RR) 160 is 0.98 to 1.02 times, and in that draw ratio the yarn is shrunk or stretched slightly.

In the present invention the speed of first feed roller (1FR) 110 and second feed roller (2FR) 120 is 2 to 6, commonly 3 to 5 kilometers per minute. Accordingly the speed of winding is not less than 6.5 kilometers per minute. The drawn yarn, after tension controlling roller (RR) 160 is wound as a package of drawn yarn 200 around a bobbin which is rotated by winder 190. It is advantageous to use a winding machine having an automatic change element. In that winding machine the yarn may be wound at a speed of about 4 kilometers per minute, and the speed of the rollers and winder may be increased, and thereafter the yarn may be transferred to another bobbin automatically when the bobbins attain a predetermined speed.

The resulting polyester multifilament yarn has the following combination of characteristics;

(A) an initial modulus (Mi) of 90 to 130 grams per denier, (B) a terminal modulus (Mt) of 0 to 15 grams per denier, (C) a shrinkage index value of 2 to 8 percent expressed by the ratio of the shrinkage (ΔS) at dry heating to the intrinsic viscosity (IV)

(D) a birefringence value (Δn) of $165\times10^{-3}$ to $190\times10^{-3}$, (E) a crystalline orientation function ($f_c$) of 0.93 to 0.97, (F) a crystal size of (D) of 47 to 55 angstroms, (G) a long period (Lp) of 130 to 145 angstroms, (H) a molecular orientation index in the amorphous resin ($\bar{F}$) of 0.80 to 0.92, and (I) a concentration of carboxyl end groups (—COOH) of 0 to 25 equivalents per $10^6$ grams of the polymer.

The above mentioned characteristics are defined or measured as follows;

(A) Initial modulus (Mi)

The initial modulus (Mi) is defined and measured by JIS-L1017. A Tenacity-elongation curve is obtained by measurement under the following conditions. The hank-shaped sample of multifilament yarn is conditioned for 24 hours at 20° C. and 65 percent relative humidity. Thereafter the tensile properties are determined using a "Tensilon" (Registered Trade Mark) UTM-4L type tensile tester (which is produced by Toyo Boldwin Company) with a sample length of 25 centimeters and a tensile speed of 30 centimeters per minute. By the resulting stress-elongation curve, an initial modulus (Mi) is determined in accordance with JIS-L1017.

(B) Terminal modulus (Mt)

Figure 5:
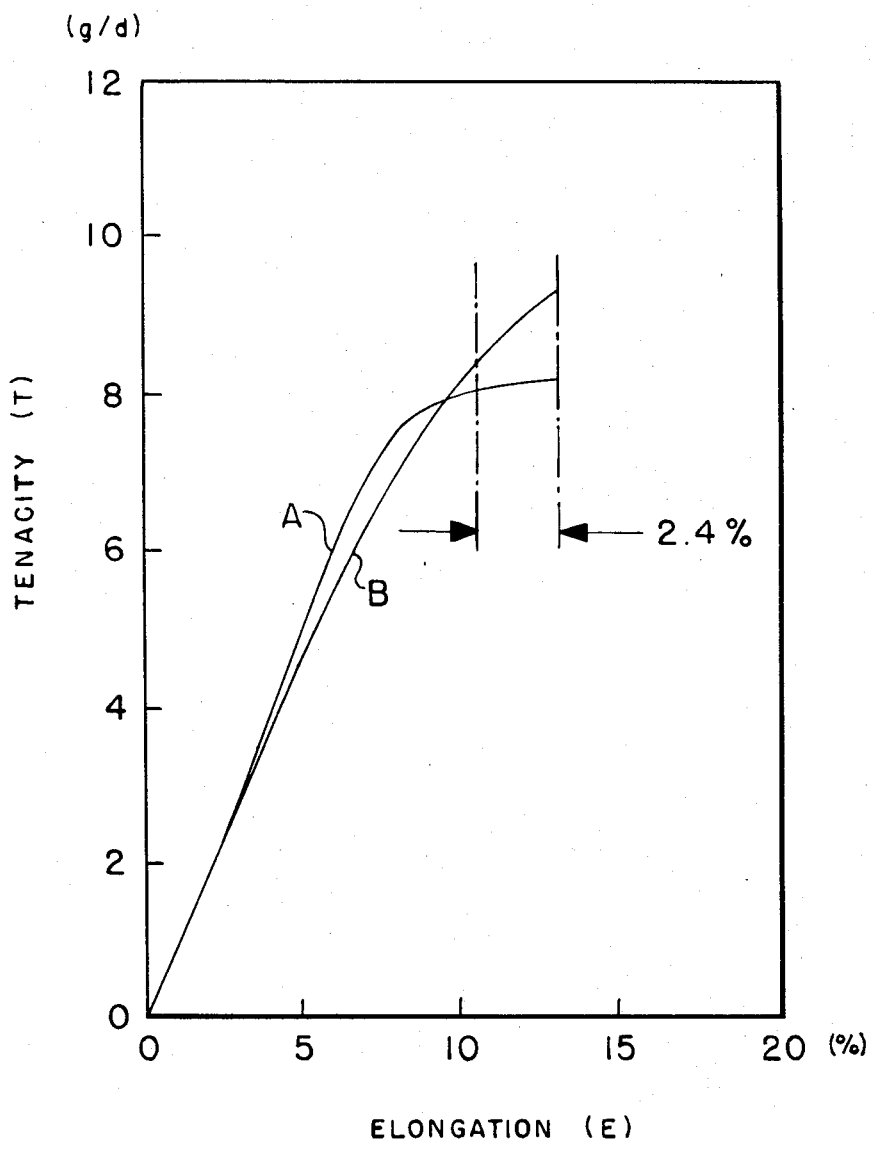
FIG. 5 illustrates a Tenacity-elongation curve of the polyester multifilament yarn of the present invention.

The terminal modulus (Mt) is determined by a similar Tenacity-elongation curve to the initial modulus (Mi). A Tenacity-elongation curve is illustrated in FIG. 5. On the tenacity-elongation curve in FIG. 5, the increase of the tenacity (ΔT(g/d)) between elongation point (E (%)) and a certain point (E−2.4 (%)) is obtained. A terminal modulus is calculated from the following equation;

$$\text{Terminal modulus } (Mt) = \frac{\Delta T}{2.4\times10^{-2}}\ (g/d)$$

(C) (a) Shrinkage (ΔS) at dry heating

A hank-shaped sample of the multifilament yarn is conditioned for more than 24 hours at 20° C. and 65 percent relative humidity. Thereafter the length ($l_0$) is measured under a stress of 0.1 gram per denier. Then the sample is conditioned for 24 hours at the atmosphere of 20° C. and 65 percent relative humidity again, after which the sample is further conditioned in a relaxed state for 30 minutes in an oven heated at 150° C. Thereafter the strength ($l_1$) of the sample is measured under a stress of 0.1 gram per denier. The shrinkage (ΔS) at dry heating may be calculated from the following equation;

$$\Delta S=[(l_0-l_1)/l_0]\times100(\%)$$

(b) Intrinsic viscosity

The intrinsic viscosity (IV) is determined by measurement of the relative viscosity ($\eta_r$) of a solution of 8 grams of polymer in 100 ml. of o-chlorophenol at 25° C. and calculated from the following equation;

$$IV=0.0242\eta_r+0.2634$$

$$\eta_r=(t\times d)/(t_0\times d_0)$$

t=falling time of the sample solution in a viscometer $t_0$=falling time of the o-chlorophenol solvent in the viscometer d=density of the sample solution at 25° C.

$d_0$=density of the o-chlorophenol solvent at 25° C.

(D) Birefringence (Δn)

Birefringence (Δn) of the filament is determined by using a Berek compensator mounted in a polarizing light microscope using Natrium D ray as a light source. The birefringence of the undrawn filament is expressed by $\Delta n_S$, and the that of the drawn filament by $\Delta n_D$.

(X-ray diffraction)

X-ray diffraction is measured by a wide-angle X-ray diffraction and small-angle X-ray diffraction apparatus using $CuK_\alpha$ ray as an X-ray source.

(E) Crystalline orientation function ($f_c$)

The half width is measured from the intensity distribution curve which is along the Debye ring on each (0 1 0) and (1 0 0) of equatorial line interference. The crystalline orientation function ($f_c$) is calculated from the following equation by substituting the average value of the resulting half width on (0 1 0) and the resulting half width on (1 0 0) as a half width (H°) in it.

$$f_c=(180°-H°)/180°$$

(F) Crystal size (D)

Crystal size is calculated from the Scherrer's equation by substituting the half width ($\beta'$) of the intensity distribution curve on (0 1 0) of equatorial line snanning.

$$D=K\lambda/\beta\cos\theta$$

where

K=Scherrer's constant (where K=1)

λ=wavelength of X-ray (where λ=1.5418 angstrom)

θ=diffraction angle (Bragg angle) (degree)

β=half width (radian) which is obtained the following equation $$\beta^2=\beta'^2-\beta''^2$$

β'=measured value of half width (radian)

β''=error of the half width of the complete crystal (Si single crystal) caused by the apparatus (where β''=0.75°, namely 0.01309 radian)

(G) Long period (Lp)

The long period is calculated using Bragg's equation, by substituting the distance of the interference along the fiber axis on interference obtained from four points, the radius of the lense in camera, and the geometrical condition of the apparatus, in it.

(H) Molecular orientation index in the amorphous region ($\overline{F}$)

A sample is immersed in an aqueous solution of 0.2 weight percent of fluorescent agent "Mikerphor ETN" (Registered Trade Mark, which is produced by Sumitomo Kagaku Kogyo Corporation) for 3 hours at 55° C. Thereafter the sample is adequately washed with water and dried. The relative intensity of the polarizing fluorescence is measured at an excitation wavelength of 365 nona meter and at a fluorescent wavelength of 420 nona meter using FOM-1 polarizing light microscope (which is produced in Nihon Bunko Kogyo Corporation). The molecular orientation index in the amorphous region ($\overline{F}$) is caluculated from the following equation.

$$\overline{F}=1-B/A$$

where

A=relative intensity of the polarizing fluorescence along the fiber axis

B=relative intensity of the polarizing fluorescence along the perpendicular orientation to the fiber axis (I) Concentration of carboxyl end groups (—COOH)

One gram of the sample is completely dissolved in 20 milliliters of o-cresol. Then the solution is cooled and 40 milliliters of chloroform are added to the solution. The concentration of carboxyl end groups (—COOH) is measured by titration with a potentiometer using a methanol solution of sodium hydroxide.

Since the present spun multifilament yarn is solidified gradually, the crystals in the fine structure of the multifilament yarn develop into highly complete crystals in the oriented crystallization process of spinning. The crystals develop such that they become long along the perpendicular to the fiber axis and relatively short along the fiber axis. This crystal structure influences the fine structure of the drawn multifilament yarn. The present drawn multifilament yarn has the characteristics of a long period ($L_p$) of 130 to 150 angstrom, preferably 130 to 145 angstrom, and a crystal size (D) of 47 to 55 angstrom preferably 48 to 55 angstrom, the crystalline orientation function ($f_c$) of 0.93 to 0.97. These characteristics are the important structural characteristics of the present invention in accordance with the structure of the crystallized part being extremely stable. That is, the characteristics mean that the long period (Lp) is shorter, the size of the crystal (D) is larger, and the crystalline orientation function (fc) is larger than in the prior polyester multifilament yarn. For example, the prior polyester multifilament yarn has a crystalline orientation function (fc) of more than 0.93, but has a long period (Lp) of more than 152 angstrom and crystal size (D) of less than 45 angstrom.

By high speed spinning, an appropriate two layer structure is formed in a cross section of the filament. Its fundamental structure is maintained in the drawn filament. As a result the drawn filament has an extremely low terminal modulus of 0 to 15 grams per denier, preferably 0 to 10 grams per denier, in spite of having high initial modulus of 90 to 130 grams per denier, preferably 100 to 130 grams per denier. On the other hand, the polyester multifilament yarn which is obtained by the prior method has an initial modulus of more than 90 grams per denier and has a terminal modulus of more than 20 grams per denier.

In the present multifilament yarn which has the above characteristics, the fine structure is extremely stable. Therefore, its fundamental characteristics are maintained after twisting the yarn, treating with an adhesive, and heat-treating in a stretched condition, etc. in the general way. Another important characteristic of of the present fine structure is the low molecular orientation index in the amorphous region ($\overline{F}$) of 0.80 to 0.92, preferably 0.80 to 0.88. This characteristic causes low shrinkage, namely a shrinkage index value of 2 to 8 percent, preferably 2 to 6 percent, and highly improved resistance to fatigue and heating as textile reinforcement of the rubber matrix of tires. The present multifilament yarn has a low molecular orientation index in the amorphous region ($\overline{F}$). Therefore it has a low birefringence (Δn) of $165\times10^{-3}$ to $190\times10^{-3}$, preferably $165\times10^{-3}$ to $185\times10^{-3}$ in spite of high crystalline orientation function (fc). The birefringence inhibits the degree of the total molecular orientation of the crystalline and the amorphous regions of the filament. When a multifilament yarn, having amorphous portions consisting of relaxed and loosened molecular chains is buried in the rubber matrix, and heated to high temperature in order to vulcanize the rubber, water, oxygen gas, active gas, etc., easily penetrate into the amorphous part of the filament. Therefore the multifilament, in particular the molecular chains in the amorphous portion in the rubber are rapidly hydrolized by heating. In order to prevent the hydrolysis by heating, the present multifilament yarn must have a concentration of carboxyl end groups (—COOH) of 0 to 25 equivalents per $10^6$ grams of the polymer, preferably less than 18 equivalents per $10^6$ grams of the polymer. The carboxyl end groups (—COOH) of the polymer act as a catalyst for the hydrolysis reaction.

The present multifilament yarn is completed by satisfying the above-mentioned characteristics. After this multifilament yarn is twisted, treated with the adhesive, and heat-treated in a stretched condition, the resulting yarn is used as textile reinforcement of the rubber matrix of the radial tire. When the resulting yarn is used as above mentioned, the characteristics of the present multifilament yarn may be most clearly apparent. That is, the tire cord derived from the present polyester multifilament yarn is able to maintain the fundamental characteristics of the fine structure as a whole without remarkably decreasing one or two characteristics of the yarn. Accordingly that tire cord has high tenacity, high modulus and high resistance to fatigue and durability to heating. In particular with respect to the durability, that tire cord has improved resistance to the fatigue that is caused when the tire cord is sequentially stretched and compressed during each tire revolution on driving, since the present multifilament yarn has the fine structure consisting of the stable crystal region and stable amorphous region. For example, according to Goodyear Mallory Fatigue Test, the fatigue lifetime of the tire cord of the present invention is 3 to 10 times that of the prior tire cord.

The tire cord of the present polyester multifilament yarn has improved durability on heating, since the yarn has less concentration of carboxyl end groups (—COOH) than the prior tire cord. The tire cord of the present invention is superior in chemical durability as well as mechanical durability. Therefore it is advantageous to use this tire cord in large-size tires that receive severe mechanical fatigue as well as much generation of heat during tire revolution on driving. The present multifilament yarn is useful not only as tire cord but also in such applications as belts, such as V belts, timing belts, conveyer belts, and the like, rubber seats reinforced with textile reinforcement, coated fabrics, etc.

The present invention is concretely illustrated by the following Examples. The characteristics which are used in the Examples and are not defined above, are defined and measured as follows;

(1) Tenacity, Elongation, and Intermediate elongation

Tenacity and elongation are defined and measured by JIS-L1017. The degree of the intermediate elongation (ME) of the multifilament yarn means the elongation under a stress of 4.5 grams per denier. The intermediate elongation (ME) of the tire cord means the elongation under the stress of 2.25 grams per denier.

(2) Retention of strength ($\epsilon$)

$$\text{Retention of the strength in the raw cord } (\epsilon 1) = \frac{\text{strength in the raw cord}}{\text{strength in the multifilament yarn} \times 2} \times 100\ (\%)$$

$$\text{Retention of strength in the dipped cord } (\epsilon 2) \text{ (tire cord)} = \frac{\text{strength in the dipped cord}}{\text{strength in the multifilament yarn} \times 2} \times 100\ (\%)$$

(3) Shrinkage on heating of the dipped cord in the air

The shrinkage is measured by the same method that is applied to the multifilament yarn as above mentioned, except that a temperature of heating of 180° C. is adopted.

(4) Intermediate elongation after heat-treating in a relaxed condition (MEH)

The dipped cord is left for 30 minutes in an oven heated at 180° C. under the relax condition. Thereafter a Tenacity-elongation curve is measured. Intermediate elongation (MEH) is defined the elongation under a stress of 2.25 grams per denier on the Tenacity-elongation curve.

(5) Fatigue lifetime of the dipped cord

The fatigue lifetime of the dipped cord is measured by ASTM-D885 (Goodyear Mallory Fatigue Test). The fatigue lifetime of the dipped cord is obtained by measurement of the explosion time of the tube under an internal pressure of the tube of 3.5 kilograms per square centimeter, a rotation speed of 850 revolutions per minute, and a tube angle of 80 degrees.

(6) Durability to hydrolysis (IMH)

A hank-shaped dipped cord is prepared. Then the strength (T1) is measured. The sample is treated for 4 days at an atmosphere of 120° C. and a saturated vapour pressure in an autoclave. Thereafter the strength (T2) is measured. Durability to hydrolysis is calculated from the following equation;

$$IMH = \frac{T2}{T1} \times 100\ (\%)$$

(7) Durability on heating in the rubber matrix (IRS)

The dipped cord is buried in the rubber matrix in fixed condition. The strength (T3) is measured. The rubber matrix is heated for 4 hours at 170° C. Thereafter the strength (T4) is measured. Durability to heating in the rubber matrix (IRS) is calculated from the following equation;

$$IRS = \frac{T4}{T3} \times 100\ (\%)$$

EXAMPLE 1

This example illustrates the relation between the fine structural parameters and the properties of the multifilament yarn and the dipped cord.

100 weight parts of terephthalic acid and 50 weight parts of ethylene glycol were charged into the autoclave, and an esterification reaction was carried out for 5 hours at 240° C. and 2 atms with removal of the water from the autoclave by distillation. Thereafter 0.02 weight parts of phosphoric acid, 0.03 weight parts of antimony trioxide, and 0.04 weight parts of ethylene glycol solution containing manganese acetate of 0.001 weight percent, were added to the esterification reaction mixture. This was heated with gradually raising the temperature to 275° C. over one hour and with decreasing the pressure to less than 1 mm Hg. Then the polymerization reaction was carried out as those conditions. Polymer chips which had an intrinsic viscosity of 0.70 deciliter per gram, a concentration of carboxyl end groups (—COOH) of 17 equivalents per $10^6$ grams per the polymer, and the chip size of 2×4×4 milliliters were obtained. Hereinafter this polymer chip is called "polymer chip P(1)".

Polymer chips P(1) were charged into a rotary type polymerization apparatus for solid phase polymerization. Solid phase polymerization was carried out at 230° C. and less than 1 mm Hg. The polymer chips have an intrinsic viscosity of 1.18 deciliters per gram and a concentration of carboxyl end groups (—COOH) of 8.5 equivalents per $10^6$ grams of the polymer. Hereinafter these polymer chips are called "polymer chips P(2)". In a method similar to that used for making polymer chips P(1), except adopting a temperature of 288° C., polymer chips which have an intrinsic viscosity of 0.70 deciliter per gram and a concentration of carboxyl end groups (—COOH) of 34 equivalent per $10^6$ grams of the polymer, were obtained. Hereinafter these polymer chips are called "polymer chips P(3)".

Polymer chips P(3) were solid phase polymerized in a method similar to that used for making polymer chips P(2). Polymer chips which have an intrinsic viscosity of 1.19 deciliter per gram and a concentration of carboxyl end groups (—COOH) of 25 equivalent per $10^6$ grams of the polymer were obtained. Herein after these polymer chips are called "polymer chips P(4)".

Polymer chips P(2) and P(4) were individually melted at 295° C. in an extruder whose screw has a diameter of 65 millimeters. The melted polymer chips were spun from a spinneret whose external diameter was 190 millimeters. The spinneret had 96 holes and 192 holes independently. The hole diameter was 0.6 millimeters. Under the spinneret, a barrel-shaped heater whose diameter was 25 centimeters and length was 43 centimeters, was disposed, and the barrel-shaped heater was heated at 320° C. The spun yarns, after passing through the barrel type heater were solidified in a barrel shaped cooler which had a uni-flow type blowing apparatus, and then lubricated using an oiling roller. Thereafter, the multifilament yarns were withdrawn on a Nelson type roller which rotated at a surface speed of 500 to 5000 meters per minute. Then the yarns were wound on a pirn shaped bobbin.

The obtained undrawn yarns were drawn using a two-step drawing method using on apparatus similar to that shown in FIG. 3, according to the drawing conditions shown in Table 1. The drawn yarns have an elongation of 11 to 13 percent. The undrawn yarns which were obtained at a spinning speed of more than 2000 meters per minute using the spinneret having 96 holes, were drawn after two undrawn yarns were combined. Each drawn yarn was 1000 denier and had 192 filaments.

Then the drawn yarns were twisted 49 turns per 10 centimeters at z orientation and 49 turns per 10 centimeters at s orientation. Raw cords were thus obtained. Each raw cord was treated with an adhesive solution using a computreter (which is produced C. A. LITZLER Co., INC (USA)), and then heat treated. Thus, dipped cords were obtained. The above-mentioned heat treatment consisted of dry heating for 50 seconds at 160° C. under a stress to maintain the length of the cord constant, heating for 120 seconds at 240° C. in a stretched condition, and 120 seconds at 240° C. in a relaxed condition. In the heat treatment, the rate of stretching and relaxing were adjusted so that the dipped cord had an intermediate elongation of about 4 to 6 percent.

In Table 1 the spinning conditions and drawing conditions of each multifilament yarn are summarized. In Table 2 the properties of each drawn yarn are summarized. In Table 3 the properties of each raw and dipped cord are summarized.

The drawn multifilament yarn, (Run Nos. 3, 4, 5, 6, 7, and 8) which were obtained at a spinning speed of more than 2000 meters per minute had larger crystalline orientation function (fc) and crystal size (D), and lower birefringence (Δn), molecular orientation index in the amorphous region ($\bar{F}$) and long period (Lp) than those of the prior multifilament yarn. Therefore the drawn yarns had extremely low terminal modulus (Mt) and shrinkage index value (ΔS/IV). The dipped cords, which were obtained from such drawn yarns, had high retention of the strength (ε1), low shrinkage (ΔS), and long fatigue lifetime.

Moreover, the present dipped cords were superior in durability to heating in the rubber matrix (IRS) when compared to the Comparative Examples (Run Nos. 9 and 10). In the Comparative Examples (Run Nos. 9 and 10) the polymer did not have a concentration of carboxyl end groups (—COOH).

TABLE 1

| | Run No. | Kind of Polymer | Spinning speed (m/min) | Birefringence $\Delta n_s$ ($\times 10^{-3}$) | Intrinsic Viscosity IV | Drawing Conditions: Temp. of 1FR (°C.) | Temp. of 2FR (°C.) | Temp. of 1DR (°C.) | 1st drawing ratio (times) | Temp. of heating plate (°C.) |
|---|---|---|---|---|---|---|---|---|---|---|
| Comparative Examples | 1 | P (2) | 500 | 2.6 | 0.92 | no heating | 90 | 110 | 4.00 | 200 |
| | 2 | P (2) | 900 | 8.1 | 0.92 | no heating | 90 | 110 | 3.00 | 200 |
| Examples | 3 | P (2) | 2000 | 21.1 | 0.91 | no heating | 90 | 110 | 2.05 | 200 |
| | 4 | P (2) | 3050 | 39.1 | 0.91 | no heating | 90 | 110 | 1.50 | 200 |
| | 5 | P (2) | 3500 | 52.3 | 0.91 | no heating | 90 | 110 | 1.30 | 200 |
| | 6 | P (2) | 4000 | 72.2 | 0.90 | no heating | 90 | 110 | 1.20 | 200 |
| | 7 | P (2) | 4500 | 88.2 | 0.91 | no heating | 90 | 110 | 1.14 | 200 |
| | 8 | P (2) | 5000 | 97.4 | 0.90 | no heating | 90 | 110 | 1.06 | 200 |
| Comparative Examples | 9 | P (4) | 2000 | 22.3 | 0.91 | no heating | 90 | 110 | 2.05 | 200 |
| | 10 | P (4) | 3050 | 37.6 | 0.91 | no heating | 90 | 110 | 1.50 | 200 |

| | Run No. | Drawing Conditions: Temp. of 2DR (°C.) | Total drawing ratio (times) | Temp. of RR (°C.) | Relaxation ratio (%) |
|---|---|---|---|---|---|
| Comparative Examples | 1 | 220 | 5.70 | no heating | 1.5 |
| | 2 | 220 | 4.21 | no heating | 1.5 |
| Examples | 3 | 220 | 2.92 | no heating | 1.5 |
| | 4 | 220 | 2.25 | no heating | 1.5 |
| | 5 | 220 | 2.00 | no heating | 1.5 |
| | 6 | 220 | 1.81 | no heating | 1.5 |
| | 7 | 220 | 1.71 | no heating | 1.5 |
| | 8 | 220 | 1.59 | no heating | 1.5 |
| Comparative Examples | 9 | 220 | 2.91 | no heating | 1.5 |
| | 10 | 220 | 2.24 | no heating | 1.5 |

TABLE 2

| | Characteristics of the Fine Structure | | | | | | Properties of the Drawn Yarn | | | |
|---|---|---|---|---|---|---|---|---|---|---|
| Run No. | Birefringence $\Delta n_D$ ($\times 10^{-3}$) | Degree of crystallinity X (%) | Crystalline orientation function ($f_c$) | Molecular orientation index in amorphous region (F) | Size of crystal D (Å) | Long period $L_p$ (Å) | Denier De (d) | Tenacity T/De (g/d) | Elongation E (%) | Intermediate elongation ME (%) |
| 1 | 192 | 49.9 | 0.932 | 0.957 | 44 | 155 | 1010 | 9.30 | 12.1 | 5.4 |
| 2 | 188 | 50.6 | 0.935 | 0.942 | 46 | 149 | 1015 | 9.01 | 12.2 | 5.5 |

TABLE 2-continued

| | | | | | | | | | | |
|---|---|---|---|---|---|---|---|---|---|---|
| 3 | 183 | 52.1 | 0.943 | 0.888 | 49 | 141 | 1025 | 8.61 | 11.9 | 4.2 |
| 4 | 181 | 52.3 | 0.943 | 0.881 | 50 | 141 | 1017 | 8.31 | 11.5 | 4.0 |
| 5 | 177 | 52.5 | 0.944 | 0.872 | 51 | 141 | 1020 | 8.14 | 11.7 | 4.2 |
| 6 | 176 | 53.1 | 0.945 | 0.870 | 53 | 141 | 1013 | 7.95 | 11.4 | 4.0 |
| 7 | 173 | 53.3 | 0.945 | 0.867 | 53 | 140 | 1015 | 7.94 | 11.4 | 4.0 |
| 8 | 173 | 53.8 | 0.946 | 0.866 | 53 | 140 | 1014 | 7.92 | 11.5 | 4.0 |
| 9 | 185 | 52.3 | 0.943 | 0.887 | 49 | 141 | 1020 | 8.65 | 11.8 | 4.2 |
| 10 | 180 | 52.4 | 0.944 | 0.880 | 49 | 141 | 1022 | 8.27 | 11.7 | 4.1 |

| | Properties of the Drawn Yarn | | | |
|---|---|---|---|---|
| Run No. | Initial Modulus Mi (g/d) | Terminal Modulus Mt (g/d) | Shrinkage at 150° C. ΔS (%) | Shrinkage index value ΔS/IV |
| 1 | 117 | 34.1 | 10.5 | 11.4 |
| 2 | 105 | 25.6 | 8.7 | 9.46 |
| 3 | 110 | 8.9 | 5.8 | 6.37 |
| 4 | 115 | 3.2 | 5.5 | 6.04 |
| 5 | 112 | 2.4 | 5.4 | 5.93 |
| 6 | 112 | 0 | 5.1 | 5.67 |
| 7 | 111 | 0 | 4.6 | 5.05 |
| 8 | 110 | 0 | 4.3 | 4.78 |
| 9 | 111 | 8.7 | 5.7 | 6.26 |
| 10 | 112 | 3.0 | 5.5 | 6.05 |

TABLE 3

| | Properties of the Raw Cord | | | | | | Properties of the Dipped Cord | | | | | |
|---|---|---|---|---|---|---|---|---|---|---|---|---|
| Run No. | Denier De (d) | Strength T (kg) | Tenacity T/De (g/d) | Elongation E (%) | Intermediate elongation ME (%) | Retention of strength ε1 (%) | Denier De (d) | Strength T (kg) | Tenacity T/De (g/d) | Elongation E (%) | Intermediate elongation ME (%) | Retention of strength ε2 (%) |
| 1 | 2183 | 15.46 | 7.08 | 15.7 | 5.9 | 82.3 | 2360 | 15.46 | 6.46 | 15.7 | 4.6 | 81.2 |
| 2 | 2196 | 15.37 | 7.00 | 15.4 | 5.9 | 84.0 | 2363 | 15.37 | 6.37 | 15.1 | 4.6 | 82.2 |
| 3 | 2216 | 15.45 | 6.97 | 15.3 | 5.7 | 87.5 | 2337 | 15.45 | 6.50 | 15.4 | 4.7 | 86.0 |
| 4 | 2199 | 15.23 | 6.93 | 15.1 | 5.3 | 90.1 | 2346 | 15.23 | 6.43 | 14.9 | 4.6 | 89.3 |
| 5 | 2211 | 15.22 | 6.89 | 15.0 | 5.3 | 91.7 | 2340 | 15.22 | 6.41 | 15.3 | 4.6 | 90.3 |
| 6 | 2190 | 14.79 | 6.75 | 15.1 | 5.1 | 91.9 | 2300 | 14.79 | 6.36 | 16.2 | 4.6 | 90.5 |
| 7 | 2209 | 14.50 | 6.56 | 15.4 | 5.0 | 90.0 | 2355 | 14.50 | 6.11 | 16.4 | 4.7 | 89.2 |
| 8 | 2204 | 14.46 | 6.56 | 15.3 | 5.0 | 90.0 | 2369 | 14.46 | 6.03 | 16.0 | 4.5 | 88.9 |
| 9 | 2210 | 15.36 | 6.95 | 15.2 | 5.6 | 87.0 | 2332 | 15.36 | 6.57 | 15.3 | 4.6 | 86.8 |
| 10 | 2215 | 15.26 | 6.89 | 15.1 | 5.3 | 90.3 | 2345 | 15.26 | 6.44 | 15.1 | 4.7 | 89.3 |

| | Properties of the Dipped Cord | | | | | |
|---|---|---|---|---|---|---|
| Run No. | Terminal modulus Mt (g/d) | Shrinkage ΔS (%) | Intermediate elongation after heating MEH (%) | Durability to hydrolysis IMH (%) | Durability to heating in rubber matrix IRS (%) | Fatigue lifetime (min) |
| 1 | 32.3 | 7.7 | 13.8 | 72 | 79.1 | 295 |
| 2 | 31.0 | 7.1 | 13.1 | 70 | 79.0 | 356 |
| 3 | 20.5 | 6.0 | 10.9 | 65 | 78.9 | 642 |
| 4 | 18.9 | 5.4 | 9.9 | 64 | 78.7 | 885 |
| 5 | 15.2 | 4.6 | 9.3 | 60 | 78.5 | 890 |
| 6 | 12.2 | 3.9 | 8.6 | 61 | 76.7 | 917 |
| 7 | 9.3 | 3.7 | 8.4 | 60 | 76.2 | 892 |
| 8 | 10.5 | 3.5 | 8.1 | 59 | 76.2 | 903 |
| 9 | 19.2 | 6.2 | 11.0 | 38 | 65.3 | 618 |
| 10 | 15.8 | 5.5 | 10.0 | 33 | 63.9 | 880 |

EXAMPLE 2

It has been demonstrated that the concentration of the carboxyl end groups (—COOH) in the polymer is related to the durability to hydrolysis in the dipped cord.

The undrawn and drawn multifilament yarns were obtained in a similar manner to that of Example 1 using polymer chips P(2), except that o-phenyl phenylglycidyl ether (OPG) was added at a constant rate as a carboxyl end group (—COOH) blocking agent at the entrance of the chips in the extruder during spinning. By adding OPG to the polymer, the concentration of carboxyl end groups (—COOH) in the polymer became further reduced.

The raw and the dipped cords were prepared in a similar manner to that of Example 1.

In Table 4 the spinning conditions and the properties of the drawn yarn are summarized. In Table 5 the properties of the raw and dipped cords are summarized.

Where 0.6 weight percent and 1.0 weight percent of OPG were added to the polymer, the properties of the drawn yarn were similar to those in Example 1, and were not inferior. The dipped cords which were obtained from the multifilament yarn of the present invention, had improved superiority in durability to heating in the rubber matrix to those of Example 1, since the concentration of the carboxyl end groups (—COOH) in Example 2 was lower than that in Example 1. The dipped tire cord according to the present invention (Run Nos. 12, 13, 14, 15, and 16) had extremely long fatigue lifetime as compared with the prior dipped cord (Run No. 11).

TABLE 4

| | Run No. | Amount of OPG (%) | Spinning speed (m/min) | Bire-fringence $\Delta n_s$ ($\times 10^{-3}$) | Characteristics of the Fine Structure: Bire-fringence $\Delta n_D$ ($\times 10^{-3}$) | Degree of crystallinity X (%) | Crystalline orientation function $f_c$ | Molecular orientation index in amorphous regionF | Size of Crystal D (Å) | Long period $L_p$ (Å) |
|---|---|---|---|---|---|---|---|---|---|---|
| Comparative Example | 11 | 0.6 | 900 | 7.9 | 181 | 48.6 | 0.932 | 0.948 | 45 | 151 |
| Example | 12 | 0.6 | 2000 | 21.0 | 179 | 49.5 | 0.943 | 0.893 | 48 | 144 |
| | 13 | 0.6 | 3050 | 39.4 | 178 | 50.3 | 0.944 | 0.883 | 50 | 143 |
| | 14 | 1.0 | 3050 | 37.2 | 178 | 49.4 | 0.943 | 0.889 | 49 | 143 |
| | 15 | 0.6 | 3500 | 55.8 | 176 | 50.9 | 0.940 | 0.880 | 49 | 144 |
| | 16 | 0.6 | 4000 | 70.1 | 177 | 51.8 | 0.940 | 0.875 | 51 | 143 |

| | Run No. | Properties of the Drawn Yarn: Intrinsic viscosity IV (dl/g) | Concentration of carboxyl end groups —COOH (eq/$10^6$g) | Denier De De (d) | Tenacity T/De (g/d) | Elonga-tion E (%) | Interme-diate Elon-gation ME (%) | Initial modulus Mi (g/d) | Terminal modulus Mt (g/d) | Shrink-age ΔS (%) | Shrink-age index value ΔS/IV |
|---|---|---|---|---|---|---|---|---|---|---|---|
| Comparative Example | 11 | 0.94 | 11.3 | 1009 | 8.92 | 12.2 | 5.7 | 105 | 26.1 | 8.8 | 9.36 |
| | 12 | 0.94 | 11.7 | 1018 | 8.03 | 12.1 | 4.8 | 106 | 9.0 | 6.8 | 7.23 |
| | 13 | 0.94 | 11.4 | 1014 | 7.62 | 11.8 | 4.7 | 103 | 3.6 | 5.8 | 6.17 |
| | 14 | 0.93 | 6.7 | 1020 | 7.54 | 12.3 | 4.7 | 101 | 3.5 | 6.0 | 6.45 |
| | 15 | 0.94 | 10.8 | 1007 | 7.50 | 12.1 | 4.6 | 107 | 2.7 | 5.6 | 5.96 |
| | 16 | 0.94 | 11.1 | 1016 | 7.33 | 11.8 | 4.0 | 102 | 0.3 | 5.5 | 5.85 |

TABLE 5

| Run No. | Properties of the Raw Cord: Strength T (kg) | Retention of strength ε1 (%) | Properties of the Dipped Cord: Strength T (kg) | Retention of strength ε2 (%) | Inter-mediate elongation ME (%) | Shrinkage ΔS (%) | Durability for hydro-lysis IMH (%) | Durability to heating in rubber matrix IRS (%) | Fatigue lifetime (min) |
|---|---|---|---|---|---|---|---|---|---|
| 11 | 14.98 | 83.2 | 14.80 | 82.2 | 4.6 | 7.5 | 85.3 | 81 | 324 |
| 12 | 14.63 | 89.5 | 14.23 | 87.1 | 4.7 | 5.8 | 82.9 | 76 | 705 |
| 13 | 14.08 | 91.1 | 13.85 | 89.6 | 4.6 | 4.8 | 81.3 | 73 | 955 |
| 14 | 13.89 | 90.0 | 13.86 | 90.1 | 4.6 | 4.9 | 86.4 | 78 | 991 |
| 15 | 13.73 | 90.9 | 13.76 | 91.1 | 4.6 | 4.2 | 80.9 | 72 | 1038 |
| 16 | 13.38 | 89.8 | 13.48 | 90.5 | 4.7 | 3.9 | 80.3 | 72 | 1088 |

EXAMPLE 3

It has been demonstrated that the multifilament yarn of the present invention has both resistance to fatigue and shrinkage stability.

Polymer chips which have an intrinsic viscosity (IV) of 0.99 and a concentration of carboxyl end groups (—COOH) of 12.3 equivalents per $10^6$ grams of the polymer were obtained in a similar manner to that of polymer chips P(2) in Example 1 except that the time of the solid phase polymerization was adjusted. Hereinafter these polymer chips are called "polymer chips P(5)".

Polymer chips which had an intrinsic viscosity (IV) of 0.98 and a concentration of carboxyl end groups (—COOH) of 29.6 equivalents per $10^6$ grams of the polymer were obtained in a manner similar to that of polymer chips P(4) in Example 1 except that the time of solid phase polymerization was adjusted. Hereinafter these polymer chips are called "polymer chips P(6)".

Polymer chips P(5) and polymer chips P(6) were individually melt-spun at 290° C. in a similar manner to that of Example 1, and the spun yarns were heated at 290° C. in a barrel type heater as in Example 1. On the other hand, polymer chips P(2) and polymer chips P(4) were individually melt-spun at 295° C. in a similar maner to that of Example 1, and the spun yarns were heated at 320° C. in a barrel type heater as in Example 1. Spinning was carried out at a speed of 3100 meters per minute. As a Comparative Example, the polymer chips were melt-spun in a similar method to the above-mentioned except that a spinning speed of 500 meters per minute was used (Run Nos. 22, 23, and 24). In Run Nos. 18 and 19, o-phenyl phenylglycidyl ether (OPG) was added at a constant rate to the polymer at the entrance of the chips into the extruder. The obtained undrawn yarns were drawn by the two-step drawing method in a similar apparatus to that of Example 1. The draw ratio was adjusted so that the elongation of the drawn yarn was about 12 percent.

In Table 6 the spinning conditions and the fine structural characteristics of the drawn yarn are summarized. In Table 7 the properties of the drawn yarn and the properties of the dipped cord are summarized.

Improved resistance to fatigue in the present multifilament yarn results from the yarn having further reduced intrinsic viscosity (IV) in the polymer, and consequently, a yarn which has good shrinkage stability (ΔS) can be obtained. Contrary to this, shrinkage stability (ΔS) causes the yarn to have further higher intrinsic viscosity (IV), and consequently, a dipped cord which is resistant to fatigue can be obtained.

The present multifilament yarn of the present invention which has high intrinsic viscosity in the polymer, had both low shrinkage (ΔS), that is, good shrinkage stability (ΔS) and long fatigue lifetime that is, resistance to fatigue. Since in the Comparative Examples (Run Nos. 20 and 21) the concentration of carboxyl end groups (—COOH) of the polymer was more than 25 equivalent per $10^6$ grams of the polymer, both durability to heating in the rubber matrix (IRS) and durability to hydrolysis were remarkably inferior to the Examples (Run Nos. 17, 18, and 19). Therefore, the multifilament yarn in Comparative Examples (Run Nos. 20 and 21) could not possess the total superior properties of the yarn of the present invention.

speed of 2000 meters per minute, had a high birefringence of $33.2\times10^{-3}$.

Also, where spinning was carried out in a similar method to the above-mentioned method except for removing the barrel type heater, yarn breaks occurred frequently even at a spinning speed of 1000 meters per minute.

TABLE 6

| | Run No. | Kind of Polymer | Amount of OPG (%) | Spinning speed (m/min) | Birefringence ΔS ($\times10^{-3}$) | Chemical Properties: Intrinsic viscosity IV (dl/g) | Chemical Properties: Concentration of carboxyl end group —COOH (eq/$10^6$g) | Fine Structural Characteristics: Birefringence $\Delta n_D$ ($\times10^{-3}$) | Fine Structural Characteristics: Degree of crystallinity X (%) |
|---|---|---|---|---|---|---|---|---|---|
| Examples | 17 | P(5) | 0 | 3100 | 57.6 | 0.83 | 17.0 | 180 | 52.7 |
| | 18 | P (5) | 0.4 | 3100 | 56.3 | 0.83 | 8.0 | 179 | 52.0 |
| | 19 | P (2) | 0.4 | 3100 | 46.5 | 0.93 | 6.4 | 177 | 49.9 |
| Comparative Examples | 20 | P (6) | 0.4 | 3100 | 59.6 | 0.82 | 37.1 | 180 | 54.4 |
| | 21 | P (4) | 0.4 | 3100 | 46.7 | 0.92 | 34.7 | 178 | 51.0 |
| | 22 | P (3) | 0 | 500 | 2.1 | 0.69 | 40.3 | 199 | 54.5 |
| | 23 | P (6) | 0 | 500 | 2.3 | 0.82 | 36.8 | 195 | 52.1 |
| | 24 | P (4) | 0 | 500 | 2.3 | 0.92 | 35.1 | 192 | 48.9 |

| | Run No. | Fine Structural Characteristics: Crystalline orientation function $f_c$ | Molecular orientation function in amorphous region F | Size of crystal D (Å) | Long period $L_p$ (Å) |
|---|---|---|---|---|---|
| Examples | 17 | 0.945 | 0.890 | 52.7 | 139 |
| | 18 | 0.945 | 0.893 | 52.0 | 141 |
| | 19 | 0.944 | 0.880 | 49.9 | 141 |
| Comparative Examples | 20 | 0.946 | 0.890 | 54.4 | 141 |
| | 21 | 0.943 | 0.879 | 51.0 | 141 |
| | 22 | 0.939 | 0.965 | 54.5 | 155 |
| | 23 | 0.936 | 0.961 | 52.1 | 154 |
| | 24 | 0.935 | 0.958 | 48.9 | 155 |

TABLE 7

| Run No. | Properties of the Draw Yarn: Denier De (d) | Strength T (kg) | Tenacity T/De (g/d) | Elongation E (%) | Intermediate elongation ME (%) | Initial modulus (g/d) | Terminal modulus Mt (g/d) | Shrinkage ΔS (%) | Shrinkage index value ΔS/IV | Intermediate elongation after heating MEH (%) |
|---|---|---|---|---|---|---|---|---|---|---|
| 17 | 1018 | 7.87 | 7.73 | 11.9 | 4.8 | 106 | 3.8 | 4.2 | 5.06 | 12.4 |
| 18 | 1001 | 7.71 | 7.70 | 12.2 | 4.9 | 105 | 3.8 | 4.3 | 5.18 | 12.7 |
| 19 | 1022 | 8.24 | 8.06 | 11.8 | 4.8 | 105 | 3.6 | 5.7 | 6.12 | 14.8 |
| 20 | 1010 | 7.63 | 7.55 | 12.3 | 4.7 | 104 | 4.3 | — | 5.36 | 12.0 |
| 21 | 1017 | 8.54 | 8.40 | 12.0 | 4.9 | 102 | 3.9 | — | 6.09 | 14.7 |
| 22 | 1020 | 8.55 | 8.38 | 11.7 | 5.5 | 121 | 33.4 | — | | 17.2 |
| 23 | 1006 | 8.82 | 8.77 | 12.2 | 5.4 | 118 | 30.1 | — | 10.1 | 18.5 |
| 24 | 1015 | 9.42 | 9.28 | 12.0 | 5.0 | 120 | 27.6 | — | 11.1 | 20.2 |

| Run No. | Properties of the Dipped Yarn: Strength T (kg) | Retention of strength $\epsilon_2$ (%) | Durability to hydrolysis IMH (%) | Fatigue lifetime (min) |
|---|---|---|---|---|
| 17 | 1388 | 88.2 | 51 | 783 |
| 18 | 1380 | 89.5 | 65 | 821 |
| 19 | 1470 | 89.2 | 82 | 984 |
| 20 | 1357 | 88.9 | 31 | 466 |
| 21 | 1524 | 89.2 | 35 | 836 |
| 22 | 1412 | 82.6 | 21 | 84 |
| 23 | 1491 | 84.5 | 41 | 164 |
| 24 | 1586 | 84.2 | 46 | 236 |

COMPARATIVE EXAMPLE 1

Polymer chips P(2) were melt-spun in a similar method to Example 1 except that the barrel type heater disposed immediately below the spinneret was not heated positively. The temperature 10 centimeters and 30 centimeters below the spinneret were 250° C. and 150° C. respectively. The industrial handling of the spinning was extremely bad. The yarn-breaks occurred frequently at a spinning speed of more than 2000 meters per minute, and the yarn could not be withdrawn normally. The undrawn yarn which was withdrawn at a

What we claim is:

1. A polyester multifilament yarn obtained from a polymer comprising at least 90 mol percent ethylene terephthalate as a repeating unit in the molecular chain, said polyester multifilament yarn having the following combination of characteristics;

(A) an initial modulus (Mi) of 90 to 130 grams per denier, (B) a terminal modulus (Mt) of 0 to 15 grams per denier, (C) a shrinkage index value of 2 to 8 percent expressed by ratio of the shrinkage ($\Delta S$) at dry heating to the intrinsic viscosity (IV)

(D) a birefringence value (An) of $165\times10^{-3}$ to $190\times10^{-3}$, (E) a crystalline orientation function ($f_c$) of 0.93 to 0.97, (F) a crystal size (D) of 47 to 55 angstroms, (G) a long period (Lp) of 130 to 145 angstroms, (H) a molecular orientation index in the amorphous region ($\overline{F}$) of 0.80 to 0.92, and (I) a concentration of carboxyyl end groups (—COOH) of 0 to 25 equivalents per $10^6$ grams of the polymer.

2. A process for producing a polyester multifilament yarn comprising the following steps (A) to (D);

(A) melt-spinning the polyester, comprising at least 90 mol percent ethylene terephthalate as a repeating unit in molecular chain, wherein the polymer melted and extruded from the spinneret has an intrinsic viscosity (IV) of 0.80 to 1.20 deciliters per gram and a concentration of carboxyl end group (—COOH) of 0 to 25 equivalents per $10^6$ grams of the polymer, (B) solidifying the spun multifialment yarn gradually by passing said yarn through a solidification zone which comprises (a) a heating zone comprising a gaseous atmosphere surrounded with a barrel-shaped heater of a length of 0.2 to 1 meter and heated at a temperature of the melting point of the polymer to 400° C., and (b) followed by a cooling zone being adjacent to the lower part of said heating zone and having an atmosphere of air blown into from the external, at a temperature of 10° to 40° C., (C) withdrawing the solidified multifilament yarn from said cooling zone at a speed (V) of 2 to 6 kilometers per minute to form a partially-oriented multifilament yarn having a birefringence ($\Delta n$) of $$0.7\times10^{-3}\times(7.2V^2-20V+30) \text{ to}$$

$$1.3\times10^{-3}\times(7.2V^2-20V+30),$$

and (D) hot drawing the partially-oriented multifilament yarn by a draw ratio of 1.4 to 3.5 times to the length before or after winding it around a bobbin as a package.

3. The polyester multifilament yarn of claim 1, wherein said initial modulus (Mi) is 100 to 130 grams per denier.

4. The polyester multifilament yarn of claim 1, wherein said terminal modulus (Mt) is 0 to 10 grams per denier.

5. The polyester multifilament yarn of claim 1, wherein said shrinkage index value is 2 to 6 percent.

6. The polyester multifilament yarn of claim 1, wherein said birefrigence value (An) is $165\times10^{-3}$ to $185\times10^{-3}$.

7. The polyester multifilament yarn of claim 1, wherein said molecular orientation index in the amorphous region ($\overline{F}$) is 0.80 to 0.88.

8. The polyester multifilament yarn of claim 1, wherein said concentration of carboxyl end groups (—COOH) is 0 to 18 equivalents per $10^6$ grams of the polymer.

* * * * *